US005147504A

United States Patent [19]

Henricson et al.

[11] Patent Number: 5,147,504

[45] Date of Patent: Sep. 15, 1992

[54] APPARATUS FOR TREATING PULP IN A PRESSURIZED STATE

[75] Inventors: Kaj Henricson, Kotka; Olavi Pikka, Karhula, both of Finland

[73] Assignee: A. Ahlstrom Corporation, Noormarkku, Finland

[21] Appl. No.: 573,388

[22] Filed: Aug. 24, 1990

Related U.S. Application Data

[63] Continuation-in-part of Ser. No. 500,475, Mar. 28, 1990.

[30] Foreign Application Priority Data

Mar. 29, 1989 [FI] Finland ..... 891484

[51] Int. Cl.[5] ..... D21C 9/00

[52] U.S. Cl. ..... 162/55; 162/251; 162/261; 210/416.1

[58] Field of Search ..... 162/55, 261, 380, 251; 8/156; 68/181 R; 209/17, 211, 268, 269, 273; 210/416.1, 768, 808; 241/67, 79.1

[56] References Cited

U.S. PATENT DOCUMENTS

| | | | |
|---|---|---|---|
| 1,933,609 | 11/1933 | Wagner | 141/12 |
| 3,664,501 | 5/1972 | Cowan | 209/273 |
| 4,167,438 | 9/1979 | Holz | 162/4 |
| 4,594,152 | 6/1986 | Gullichsen | 209/273 |
| 4,961,844 | 10/1990 | Ekholm et al. | 209/273 |
| 4,968,417 | 11/1990 | Ahs | 209/273 |

OTHER PUBLICATIONS

"Chesapeake—The West Point Pulp and Paper Mill" (Brochure 1986).

"Ahlstrom Fiber Flow Ensovac" (Brochure 1987).

*Primary Examiner*—W. Gary Jones

*Assistant Examiner*—Charles K. Friedman

*Attorney, Agent, or Firm*—Cohen, Pontani Lieberman & Pavane

[57] ABSTRACT

An apparatus for treating a pulp suspension in a screening plant of a pulp mill wherein impurities are separated from defibered pulp by screening and/or cleaning, the cleaned pulp is thickened, the impurities are further treated in the screening plant by screening and defibering the accept fiber material for further screening and thickening and further impurities are removed from the screening plant after various screening stages, the apparatus including means for effecting one or both of the pulp screening and cleaning stages in a closed, pressurized space in the screening plant and preventing the access of air to the pulp treated by effecting the thickening stages in a pressurized state and at the initial pressure of one or both of the preceding screening and cleaning stages.

4 Claims, 4 Drawing Sheets

APPARATUS FOR TREATING PULP IN A PRESSURIZED STATE

CROSS-REFERENCE TO RELATED APPLICATION

This is a continuation-in-part of U.S. patent application Ser. No. 500,475, filed Mar. 28, 1990.

FIELD OF THE INVENTION

The present invention relates to a method and apparatus for treating pulp. In particular, it is suitable for treating fiber suspensions of the pulp and paper industry and, more specifically, it is directed to the development of screening plants in pulp and/or paper mills, making their operation more effective and reducing their need for equipment, thus enabling a considerable reduction in investment costs.

BACKGROUND OF THE INVENTION

Woodpulp is manufactured in the pulp and paper industry by various methods. Pulp can be manufactured chemically by cooking or mechanically by grinding and refining. It is also manufactured from waste paper by defibering the waste paper in a pulper. It is common to all pulp manufacturing methods that the pulp contains more or less impurities which must be removed therefrom. Pulp is cleaned in a screening plant by means of washers, thickeners, screens and cleaners. A screen is an apparatus in which pulp in the consistency range of about 1 to about 5% is cleaned by either a slotted screen or a perforated screen. The cleaner, normally a so-called centricleaner, is an apparatus in which pulp is cleaned by centrifugal force in a low, usually less than 1%, consistency. Thickeners and washers are used to remove from the fiber suspension liquor and impurities dissolved in the liquor, such impurities being in the form of small particles capable of passing through the filtering media. However, screening involves two major problems. First, it is usually desirable after screening to increase the pulp consistency to a range of about 10 to about 15% for storing or after-treatment. Secondly, handling of the reject is also desirable by either refining or some other method, but usually at a higher consistency than that present during screening. In other words, the pulp flows must always be thickened after screening. There have been attempts to resolve this problem such as, for example, by the Swedish company Kamyr AB. Their solutions aim at raising the consistency to 8–15% in the screening equipment. Efforts have been made in developing both screens and cleaners which will operate at a consistency of about 10%. However, this has been only partially successful. Screening and cleaning as such can be performed rather successfully at a high consistency, but the separation efficiency of the screens and cleaners is substantially decreased as the consistency increases. It can thus be said that Kamyr has replaced one problem with another, i.e. they have eliminated the need for thickening at the cost of decreased cleaning efficiency.

SUMMARY OF THE INVENTION

The present invention comprises a method and apparatus for screening pulp in a pressurized, closed space with screens at a consistency range of about 1 to about 5% and with centricleaners at a consistency of less than 1%. The method of treating a pulp suspension in accordance with the invention is carried out in a screening plant of a pulp or paper mill wherein reject impurities are separated from defibered pulp by screening, thickening and/or cleaning. The inventive method specifically includes effecting one or both of the pulp screening and cleaning stages in a closed, pressurized space in the screening plant and preventing the access of air to the pulp treated by effecting the thickening stages in a pressurized state and at the initial pressure of one or both of the preceding screening and cleaning stage. An apparatus for carrying out the method of the invention is also provided.

BRIEF DESCRIPTION OF THE DRAWINGS

The method and apparatus of the present invention will be described in more detail below, by way of example, with reference to the accompanying drawings, in which.

DETAILED DESCRIPTION OF THE PRESENTLY PREFERRED EMBODIMENT

Figure 1:
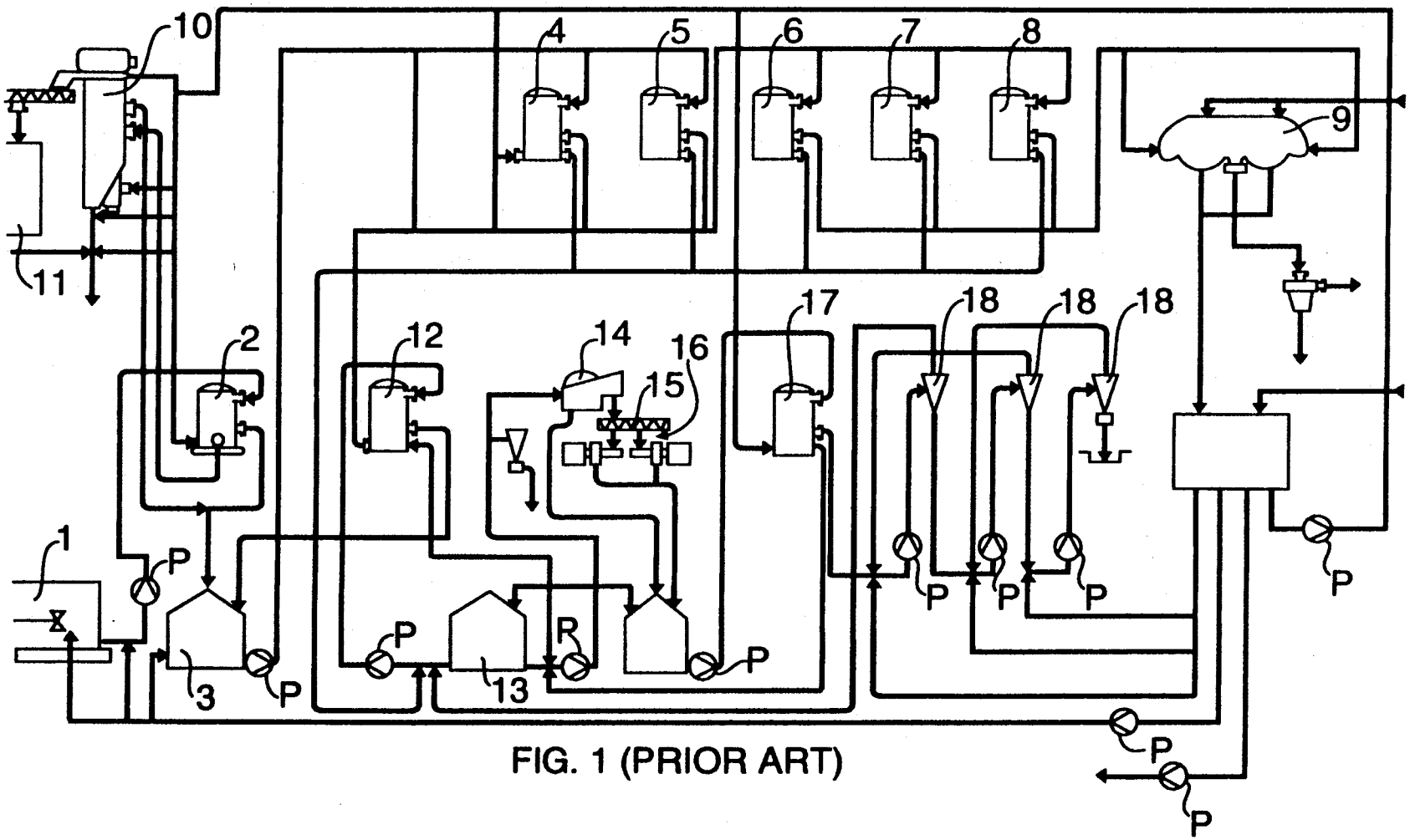
FIG. 1 (PRIOR ART)
FIG. 1 is a basic schematic illustration of a screening plant according to the prior art.

FIG. 1 is a basic schematic illustration of a screening plant which is commonly used today. Its construction and operation are described in more detail below. Although many other screening plant arrangements which considerably differ from the details of the diagram shown in FIG. 1 exist, FIG. 1 presents the commonly used basic principle of screening. In the accompanying drawings, pumps used in pulp feeding are generally marked with a reference letter P because the pumps themselves have no substantial significance to the invention. Pulp is fed in a consistency of about 5% from a pulp storage vessel 1 through a knotter 2 and intermediate tank 3 to screens 4–8 which, in the embodiment of FIG. 1, are divided into two stages, the first being comprised of screens 4 and 5 and the second of screens 6, 7 and 8. The cleaned pulp from the last screen is taken to one or more suction filters 9. In the knotter 2, knots and large foreign particles or the like are separated from the pulp and are further taken to the knot scrubber 10, where acceptable fiber material is separated from the knot pulp and is returned to the intermediate tank 3. The knot material is removed from the knot scrubber 10 and is taken for further treatment, in the embodiment of the Figure, through a knot silo 11. Shives, fiber bundles and small impurities or the like are separated from the pulp in screens 4–8. The reject from screens 4 and 5 is led into a secondary screen 12. The accept from said screen 12 is led into screens 6, 7 or 8 of the second screening stage and the reject into an intermediate tank 13 or directly to a reject thickener 14, wherefrom it is further conducted by means of a feed screw 15 to a refining stage 16. Refined pulp from the refiner as well as the rejects from the screens 6, 7 and 8 of the second stage are led to another secondary screen 17, the accept of which is led to cleaners 18. The accept from the cleaners 18 is conducted to either the intermediate tank 13 or directly to the first secondary screen 12. The accept pulp from the screens enters the suction filter in a consistency of about 1 to about 2%, which also prevails after screening, because the suction filter is not capable of handling pulp of a higher inlet consistency, and the pulp is thickened to a consistency of about 10 to about 15% by drawing water therefrom by means of a gravity-operated drop leg. The inevitable result of this is that the pulp mill must have, at least for the accommodation of suction filters, a height of about 10 m. Other components of the equipment are disposed in various storeys according to need and space. Screening as described above involves the following main problems.

Firstly, by treating the pulp with screens 4 and 8 and also during transfer of the pulp, a large amount of air is mixed with the pulp and the filtrates which causes, for example, foaming. In addition, the building height required by the screens can be considered a significant drawback. If the screening plant could be of pressurized construction and hydraulically closed so as to prevent any air from mixing with pulp, all of the above-mentioned drawbacks could be eliminated.

Secondly, a great number of separate apparatus are needed. For example, a multiplicity of screens are disposed in two successive stages, the first stage comprising two screens connected in parallel and the second stage comprising three screens connected in parallel.

A great number of apparatus are also required because as high as possible a separation efficiency is aimed at in each apparatus. In other words, an effort is made to separate the desired fraction completely from the undesired fraction, i.e. the idea is to keep the reject ratio as low as possible. This results in the pulp being circulated for a relatively long time in the apparatus, whereby only a fractional part of the maximum capacity of the apparatus is used.

Thirdly, the low consistency of the fiber suspension to be treated constitutes a further problem. The low consistency in itself requires a large filter, even if one does not take into account that the suction filter is by no means the most efficient type of filter when comparing the operating efficiencies of various filter surfaces. It can be assumed, for example, that the consistency of the pulp entering the filter is approximately 1.5% which is then raised at the filter to about 15%. For the production of 15 tons of dry fiber pulp by the filter, one has to remove a total of 100 tons of 15% suspension. For this result, 900 tons of liquid must also be removed from the 1.5% pulp entering the filter. If the consistency of the pulp entering the filter is 3%, only 400 tons of liquid have to be removed and if the inlet consistency is 4.5%, only 233 tons of liquid have to be removed. Thus, if the nominal thickening capacity of the filter remains unchanged it is possible, by tripling the inlet consistency, to operate with an apparatus the thickening area of which is only about one-fourth the thickening area of the thickening apparatus required by low consistency.

Figure 2:
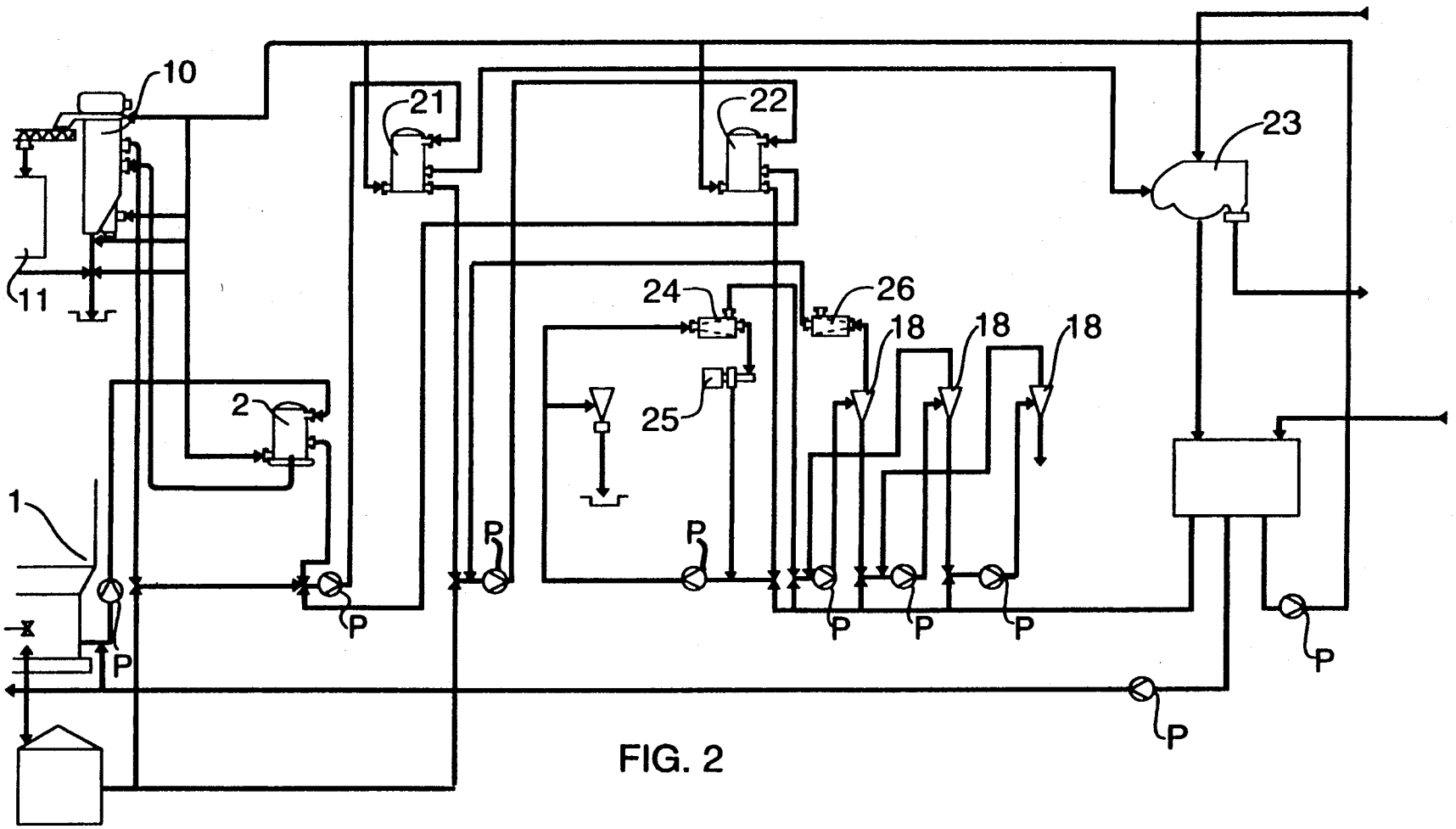
FIG. 2 is a schematic illustration of a screening plant incorporating the method and apparatus of the present invention.

FIG. 2 illustrates in more detail a method according to a preferred embodiment of the present invention and the apparatus required therefor. Pulp is fed from tank 1 to knotter 2 and, through screen 21, further to a drum displacement apparatus 23. Screening takes place in a consistency range of about 1 to about 5%, normally in a consistency range of about 3 to about 5%. The drum displacement apparatus 23 contains a drum provided with cells in which the pulp is thickened to a consistency of about 10 to about 15% at the pressure of the incoming pulp. Air should not be present in this process. An embodiment of a suitable drum displacement apparatus is disclosed, for example, in U.S. Pat. No. 4,502,171.

The reject pulp from the first screen 21 is fed directly to the second screen 22 wherefrom accept is returned to the first screen 21 and the reject is led to a pressurized, closed thickener 24 wherefrom the pulp, in a pressurized state, flows without a feed screw to a refiner 25. Pulp is fed at low consistency into the thickener 24 and filtrate is removed therefrom with the pulp in a turbulent state. Selection of holes of a suitable size, e.g. of a diameter of 1–2 mm, contributes to the primary fibers being discharged with the filtrate, while the remaining, thickened reject pulp then flows further to the refining stage. Thus, the refining and thickening of the reject pulp is also performed under pressure and no air is mixed with the pulp. A suitable thickener 24 is disclosed in Finnish patent application No. 874854. The filtrate from thickener 24 and the filtrate from the drum displacement apparatus 23 are fed together with the pulp to be cleaned to the cleaners 18, and the fraction accepted by these cleaners is conducted to a thickener 26, the filtrate of which is also fed to the cleaners 18. Thickener 26 is a pressurized water separator disclosed, for example, in Finnish patent application No. 873020. Thus, the pulp cleaning and thickening effected thereafter are also performed in a pressurized and closed state.

When comparing the equipment illustrated in FIG. 2 with the equipment of FIG. 1, it can be seen that there are differences in both the number of screens and the methods of thickening. When filtrate is removed in small pressurized thickeners, the layout of the mill is compact and the required building volume is less than about half of the building volume required by a conventional screening plant. The reject handling equipment according to FIG. 1 comprises a suction filter, a feed screw and a refiner. By means of the present invention, reject handling is managed with a thickener of considerably smaller size and without a feed screw. The number of cleaners required is not changed substantially. The only addition with respect to the equipment of FIG. 1 is the thickener 26 for the accept received from the cleaners. This thickener 26 thickens the suspension from the consistency level required by the cleaners to that required for screening. The thickening apparatus is the last component in the screening plant. According to the prior art, two such apparatus, i.e. suction filters, are needed. The filters have a size of 4×8 m, whereby the drum diameter is 4 m and the drum length is 8 m. In the system according to the present invention, only one 3.5×5 m thickening apparatus is needed.

The functionality of the apparatus according to the present invention is, on the other hand, based on the fact that the screens themselves are dimensioned and their capacity is optimized so as to be at maximum, whereby the reject ratio is relatively high, about 20 to 30%. As a consequence, the accept from the screens is absolutely clean and suitable as such to be fed directly into the thickener, thus excluding the secondary screening stage. Rather, the task of the second screen 22 is to handle the reject from the first screen 21, i.e. the suspension, which still includes a great amount of acceptable fiber fraction that is returned to the first screen. Thus, screen 22, in a way, corresponds to the screen 12 of FIG. 1 which treats the reject from the screens of the first stage.

On the other hand, the function of the method and apparatus of the present invention is based on the finding that the entire screening procedure can be accomplished at an over-pressure and that no external air is present in the process. This has been achieved by arranging pumping devices at only a few key points in the system in order to pressurize the treated suspension so that it will be transferred from one apparatus to another by said pressure. More specifically, the screening plant is divided into a number of pump—screen/cleaner—thickener combinations, in which the feed pressure of each pump is sufficient to maintain an overpressure so that, on the one hand, no external gas is allowed into the system and, on the other hand, even the pressure difference required for thickening is operated by the pumping unit of each combination.

The economical advantages referred to in the beginning of this description are best seen when reviewing the results of the following comparative calculations.

The energy consumption in a screening plant applying the method and apparatus of the present invention is about 34% less than in a conventional screening plant.

The costs of building and equipping a pulp mill are distributed as follows if the reference number 100 refers to costs in a conventional screening plant.

| Object | Conventional plant | Invention |
|---|---|---|
| pipes | 100 | 61 |
| service platforms | 100 | 60 |
| valves | 100 | 49 |
| pumps | 100 | 74 |
| mixers | 100 | 00 |
| building | 100 | 29 |
| total | 100 | 52 |

Thus, it will be appreciated that apart from the reduction in energy consumption by about a third, the costs of equipment and building, excluding electrification, instrumentation and main equipment—the inclusion of which in the calculation would cause too much inaccuracy and uncertain estimates—are only about half of the corresponding investments in a conventional pulp mill.

Figure 3:
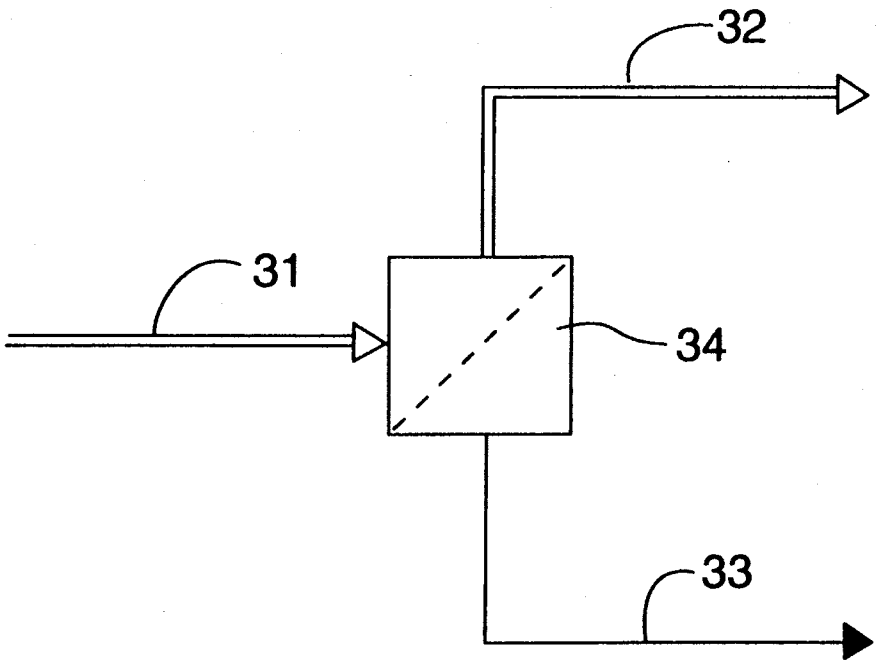
FIG. 3 is a schematic illustration of one thickening stage.

FIG. 3 illustrates the operation of a thickener 34, as for example that delineated by the reference numeral 24 in FIG. 2. The fiber suspension is introduced into the thickener 34 along a conduit 31 at a consistency of about 1% and the thickened suspension is discharged therefrom along a conduit 32 at a consistency of about 4%. Thus, about 75% of the liquid introduced into the thickener 24 is removed and is discharged as filtrate along a conduit 33. The filtrate, of course, contains about 75% of all impurities—such as black liquor and other chemicals dissolved in the liquid—and of small particles such as fines, fillers and ink which are capable of passing through the filtering media. Accordingly, a thickening stage also, at the same time, functions as a fractionating or screening stage and this manner of cleaning a fiber suspension may be employed in many processes. For example, in the process illustrated in FIG. 2 the thickener 24—in a closed, pressurized manner—removes small particles that need not be refined. Thickener 26 removes small particles such as small, dark spots and refeeds them to the beginning of the cleaning plant for recleaning.

Figure 4:
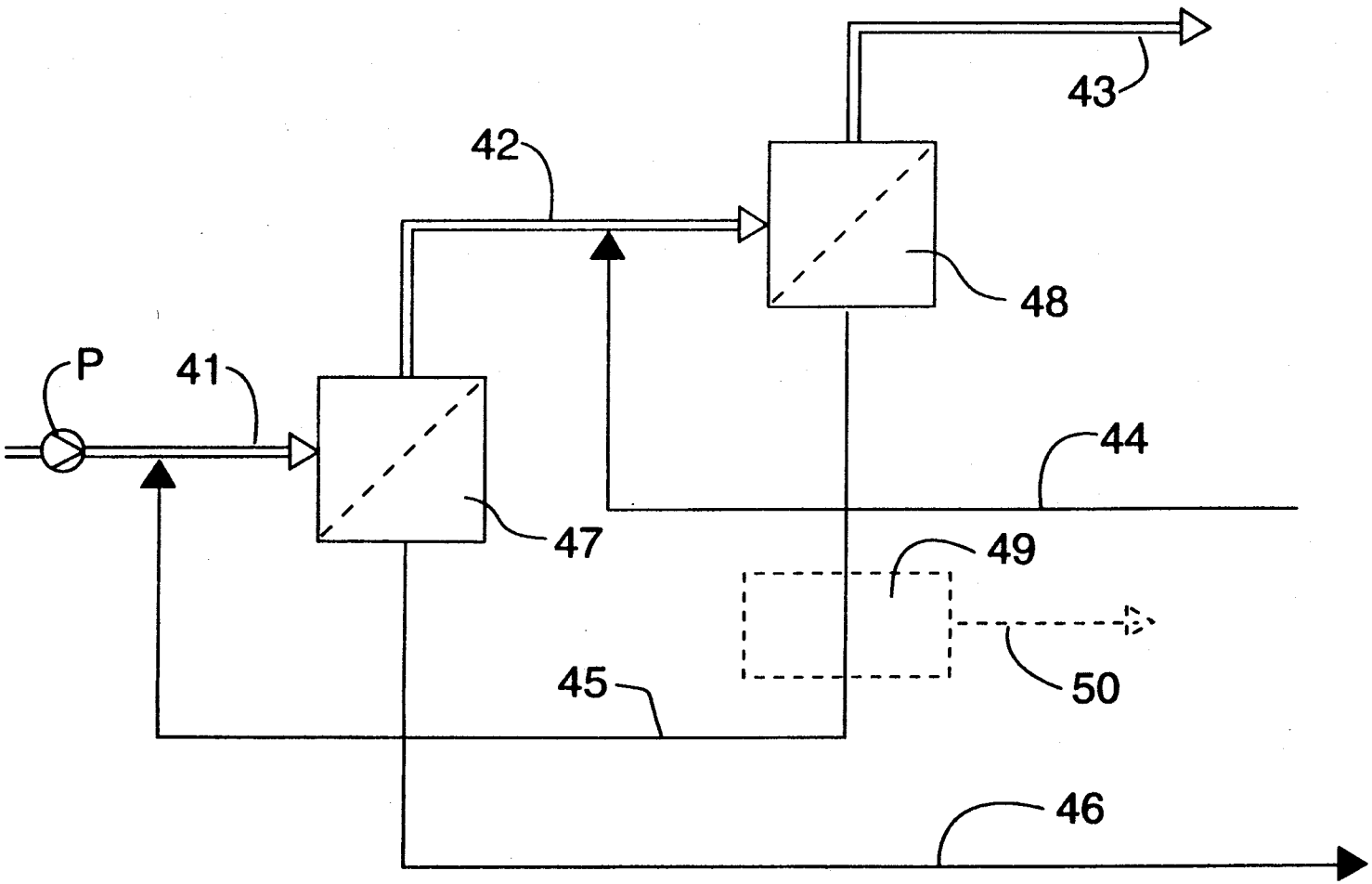
FIG. 4 is a schematic illustration of a two-stage thickening process.

FIG. 4 depicts a two-stage hydraulic pressurized fractionating or screening system that works under closed pressurized conditions. A feed pump P introduces the fiber suspension through a conduit 41 to a first thickener 47 wherefrom the thick stock flows along a conduit 42 after dilution with cleaner liquid from a conduit 44 to a second thickener 48. The filtrate from the second thickener 48 is either directly recirculated along a conduit 45 to the conduit 41 or is recirculated after cleaning in a process 49 in which a portion of the impurities are removed through a conduit 50. The process 49 may, by way of example, be implemented by a settling basin. With a two-stage process such as that in FIG. 4 cleaning efficiencies of over 90% may be attained with a rise in consistency in the thickeners 47 and 48 of from about 1% at the inlet to about 4% at the outlet. The advantages of using a closed pressurized system in the process illustrated in FIG. 4 are much the same as those described in connection with FIG. 2 when comparing the FIG. 4 illustrated process to conventional processes. The closed pressurized fractionating and thickening system makes the mill more compact and cost-efficient than where the thickeners are standard open vacuum thickeners.

In conclusion, the foregoing description provides a process for screening and cleaning pulp in a closed, pressurized space so that the consistency need not be raised to the detriment of cleaning efficiency. No equivalent process has been heretofore disclosed, where pulp is screened, cleaned, and reject handled in a closed space so that the cleaning operations themselves are effected in a consistency optimal to them, but so that the pulp is still in a high consistency state when it is led to the after-treatment stage. It is, however, understood that the method and apparatus of the invention are not limited to the embodiment described above, but that all embodiments within the scope of the accompanying claims are intended to be covered thereby.

What is claimed is:

1. A screening plant for treating pulp in a pulp mill, having means for pumping, treating and thickening, said screening plant comprising:

(a) a pump, receiving pulp and exhausting the pulp at an increased pressure;

(b) a treatment apparatus consisting of at least one of a cleaner and a screen, receiving pulp pressurized by said pump; and (c) a first thickener, receiving pulp pressurized by said pump and increasing a solids content of a portion thereof, wherein said pump, said treatment apparatus and said thickener are interconnected in closed hydraulic communication and structured so that no air enters into the pulp.

2. The screening plant according to claim 1, further comprising a fiberizer/refiner downstream of said thickener, receiving pulp pressurized by said pump, wherein said fiberizer is in closed pressurized hydraulic communication with said thickener and structured so that no air enters into the pulp, the pulp being passed from said thickener to said fiberizer.

3. The screening plant according to claim, 1, wherein:

said pump exhausts said pulp at an increased pressure;

said treatment apparatus receives the pulp pressurized by said pump and produces treated pulp; and said first thickener receives treated pulp from said treatment apparatus and pressurized by said pump.

4. The screening plant according to claim 1, further comprising a second thickener receiving pulp pressurized by said pump and increasing a solids content of a portion thereof, said first and second thickeners operating in series, wherein said first thickener is in closed pressurized hydraulic communication with said second thickener and structured so that no air enters into the pulp, the pulp being passed from said first thickener to said second thickener.

* * * * *